US005666887A

United States Patent [19]

Grabowski et al.

[11] Patent Number: 5,666,887

[45] Date of Patent: Sep. 16, 1997

[54] DESK SYSTEM

[75] Inventors: Daniel Grabowski; John W. Millhouse, both of Grand Rapids, Mich.

[73] Assignee: Steelcase Inc., Grand Rapids, Mich.

[21] Appl. No.: 510,599

[22] Filed: Aug. 3, 1995

[51] Int. Cl.[6] ..... A47B 7/00

[52] U.S. Cl. ..... 108/91; 108/93; 108/27; 312/223.6

[58] Field of Search ..... 312/197, 317.2, 312/317.3, 317.1, 223.6, 194, 249.8, 249.9, 351.3, 195; 108/91, 93, 94, 27, 92

[56] References Cited

U.S. PATENT DOCUMENTS

| | | | |
|---|---|---|---|
| 349,875 | 9/1886 | Crocker | 312/324 |
| 654,922 | 7/1900 | Schipkowsky | 312/197 X |
| 1,280,619 | 10/1918 | Leick | 312/230 |
| 2,141,954 | 12/1938 | Jones | 312/351.3 |
| 2,590,959 | 4/1952 | Granditer | 312/317.1 X |
| 2,722,287 | 11/1955 | Beinhorn | 108/92 X |
| 2,854,309 | 9/1958 | Levine | 108/93 X |
| 2,981,580 | 4/1961 | Hansen | 108/27 |
| 2,988,413 | 6/1961 | Bergen | 108/93 X |
| 3,066,994 | 12/1962 | Knoll | 312/351.3 |
| 3,856,371 | 12/1974 | Forsyth | 312/195 |
| 3,992,067 | 11/1976 | Kane | 312/194 |
| 5,451,101 | 9/1995 | Ellison et al. | 312/223.6 |
| 5,496,609 | 3/1996 | Michelstein | 108/27 X |

*Primary Examiner*—Peter M. Cuomo
*Assistant Examiner*—Janet M. Wilkens
*Attorney, Agent, or Firm*—Price, Heneveld, Cooper, DeWitt & Litton

[57] ABSTRACT

A nested table system which can be reconfigured as desired to accommodate work space requirements includes a stationary table and a movable table having legs supported on casters to facilitate repositioning thereof. The movable table has a worksurface which has dimensions, and which is supported at an elevation, which allows at least a portion of the worksurface of the movable table to be positioned underneath the worksurface of the stationary table. The nested table systems includes one or more features which helps prevent damage to the edges of the worksurface of the movable table when it is moved underneath or adjacent to the stationary table. Such features include a bumper molding which projects outwardly from the edges of the worksurface of the moveable table, arcuate side edges on the moveable table which in combination with a rearwall extending downwardly from a rear edge of the worksurface of the stationary table prevents the corners of the worksurface of the movable table from contacting rear legs of the stationary table, and a plurality of cable management channels which are preferably comprised of an energy absorbing, resiliently deformable polymeric material and which acts as bumpers.

21 Claims, 3 Drawing Sheets

DESK SYSTEM

FIELD OF THE INVENTION

This invention relates to a nested table system having a stationary table and a movable table with legs supported on casters, wherein the movable table can be repositioned as desired to make maximum use of the worksurfaces of the nested table system or to minimize the amount of space occupied by the system by positioning the movable table underneath the stationary table. More particularly, the invention relates to a nested table system which is resistant to damage on account of undesirable collisions between the worksurface of the movable table and the legs or other portions of the stationary table.

BACKGROUND OF THE INVENTION

In hotel rooms and other building spaces it can be desirable to provide a desk or table having a relatively large worksurface which can be used by business travellers and the like as a temporary office or workstation. However, in hotel rooms and the like, where available floor space is limited, it is not generally desirable to devote a large portion of the floor space to office type furniture which is utilized only occasionally. Additionally, traditional office furniture can clash with the decor of the room and detract from the desired aesthetics and ambiance which the innkeeper wishes to achieve. Accordingly, there is a need for furniture which blends into the decor of the room, normally occupies a small amount of floor space, and which can be easily reconfigured to provide ample worksurfaces for business travellers and the like when desired.

SUMMARY

The nested table system of the invention provides a furniture grouping which can be quickly and easily configured as desired to provide ample worksurfaces when required and which can also be quickly and easily rearranged into a nested configuration which occupies a relatively small amount of floor space when extra worksurfaces are not desired. The system includes a stationary table with a worksurface, and a movable table also having a worksurface and which can be freely moved about and repositioned relative to the stationary table. The nested table system includes one or more features which help to prevent the edges of the movable table from becoming damaged in the event of undesirable collisions between the movable table and the stationary table when the movable table is being repositioned.

In accordance with a first aspect of the invention, the worksurface of the movable table includes a bumper molding which projects outwardly from the edges thereof so that the energy of impact upon collision of the edges of the movable table with portions of the stationary table is absorbed by the bumper molding.

In accordance with another aspect of the invention, the stationary table has a substantially rectangular worksurface with supporting legs positioned at the corners thereof, and a rear wall which extends downwardly from the rear edge of the worksurface of the stationary table below the level of the worksurface of the movable table, while the movable table has opposing arcuate sides connected by substantially straight, parallel sides. The rear wall of the stationary table limits the extent to which the movable table can be rolled under the stationary table. Specifically, the rear wall prevents the movable table from being pushed under the stationary table and past the rear edge thereof. The arcuate edges of the movable table, in combination with the rear wall of the stationary table, prevent the corners at the intersection between the straight and arcuate edges of the worksurface of the movable table from contacting the rear legs of the stationary table regardless of the relative position of the movable table underneath the stationary table.

In accordance with a further aspect of the invention, the stationary table is provided with a rear wall which extends downwardly from the rear edge of the worksurface thereof below the level of the worksurface of the moveable table, and a plurality of cable management channels which serve a dual function of providing means for routing cable or wires from the worksurface of the stationary table to a floor or wall outlet, and of acting as bumpers to absorb impact between the edges of the movable table worksurface and the rear wall of the stationary table. The rear wall also prevents the movable table from colliding with a wall surface which would typically be adjacent the rear edge of the stationary table.

A further feature of the invention, which helps minimize damage due to undesirable collisions between the edges of the worksurface of the movable table and portions of the stationary table, is that the legs on the stationary table have enlarged upper portions which minimize contact between the edges of the worksurface of the movable table and the stationary table, and also act as a conspicuous visual guide to facilitate reconfiguring of the table system without bumping the edges of the movable table against the legs of the stationary table.

DESCRIPTION OF THE PREFERRED EMBODIMENT

Figure 1:
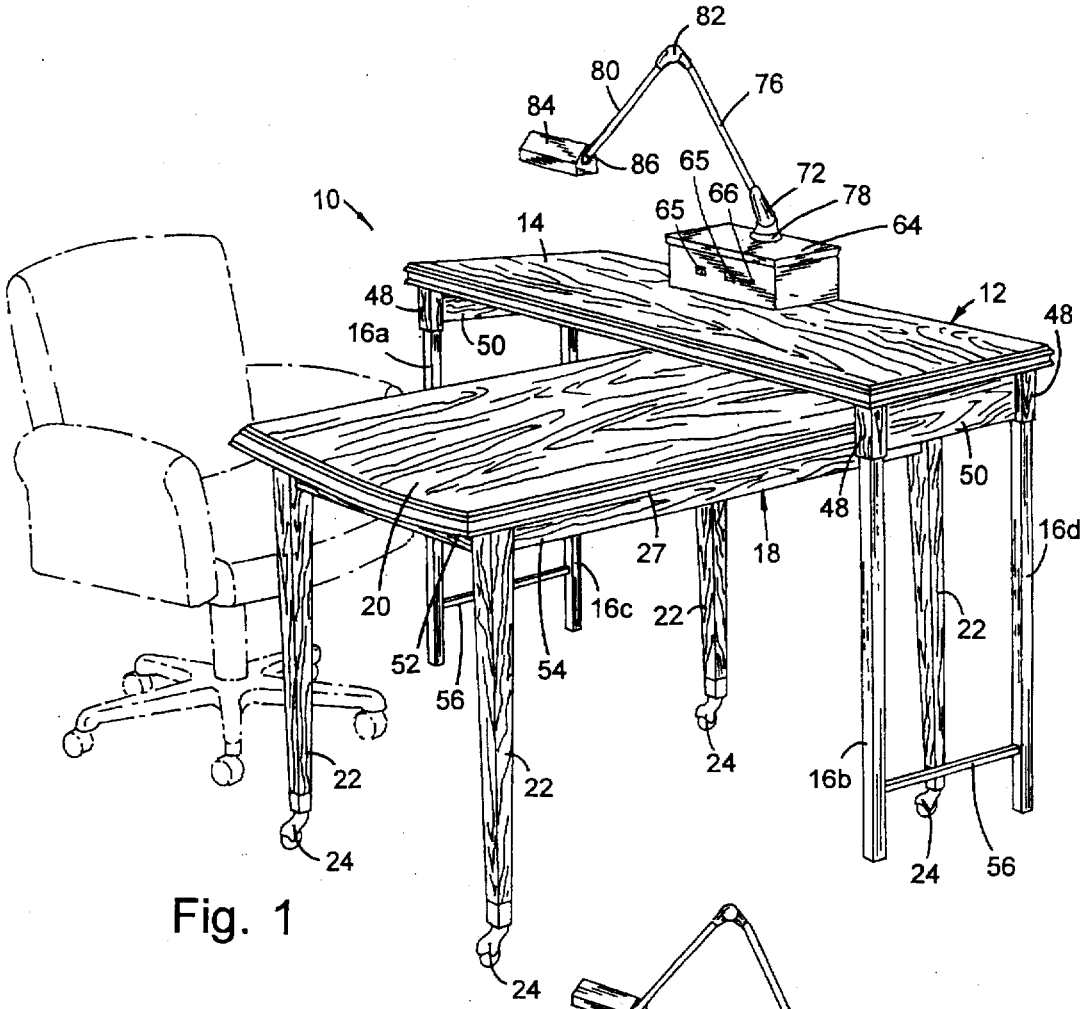
FIG. 1 is a perspective view of the nested table system of the invention arranged in an L-shaped configuration wherein substantially the entire worksurface of the movable table can be utilized.

There is shown in FIG. 1 a perspective view of a nested desk/table system 10 which comprises a stationary table 12 having a substantially horizontal worksurface 14 supported by legs 16, and a movable or rollable desk or table 18 having a substantially horizontal worksurface 20 supported by legs 22 which are supported on rollers or casters 24. The worksurface 14 of the stationary table 12 has a generally rectangular shape, with a major dimension or length in a horizontal plane. The illustrated stationary table 12 includes four legs 16 which are generally located at the four corners of the worksurface 14. The length of the worksurface 20 of the movable table 18 is less than the spacing between the legs 16 along the lengthwise direction of stationary table 12, and the top side of worksurface 20 of movable table 18 is supported by the legs 22 at an elevation which is at least slightly less than the elevation at which the underside of the worksurface 14 of stationary table 12 is supported by legs 15, so that movable table 18 can be positioned or nested beneath stationary table 12.

Figure 2:
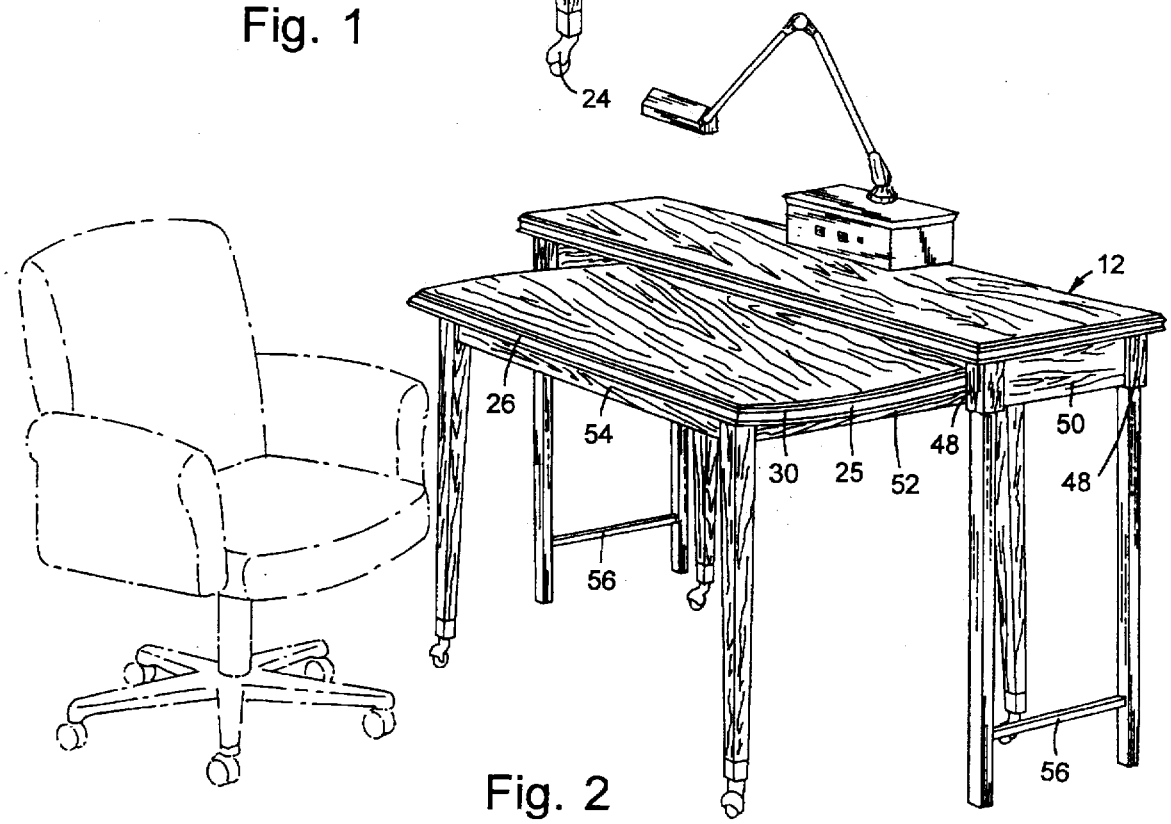
FIG. 2 is a perspective view of the nested table system of FIG. 1 with the movable table underneath the worksurface of the stationary table, i.e. in the nested position.

The ability to reposition the movable table 18 as desired allows the worksurfaces 14 and 20 to be utilized together such as in the generally L-shaped desk configuration shown in FIG. 1 if a relatively large worksurface area is needed, or, as another alternative, the movable table 18 can be stored underneath the stationary table 12 as shown in FIG. 2 to minimize the amount of floor space occupied by the table system 10 such as when less than the entire worksurface of the movable table 18 is needed. The nested table system 10 of the invention thus provides a versatile furniture grouping which can be quickly and easily reconfigured as desired to accommodate any of a variety of work space needs and which can be rearranged into the compact nested configuration, show in FIG. 2, when more floor space is preferred.

Figure 3:
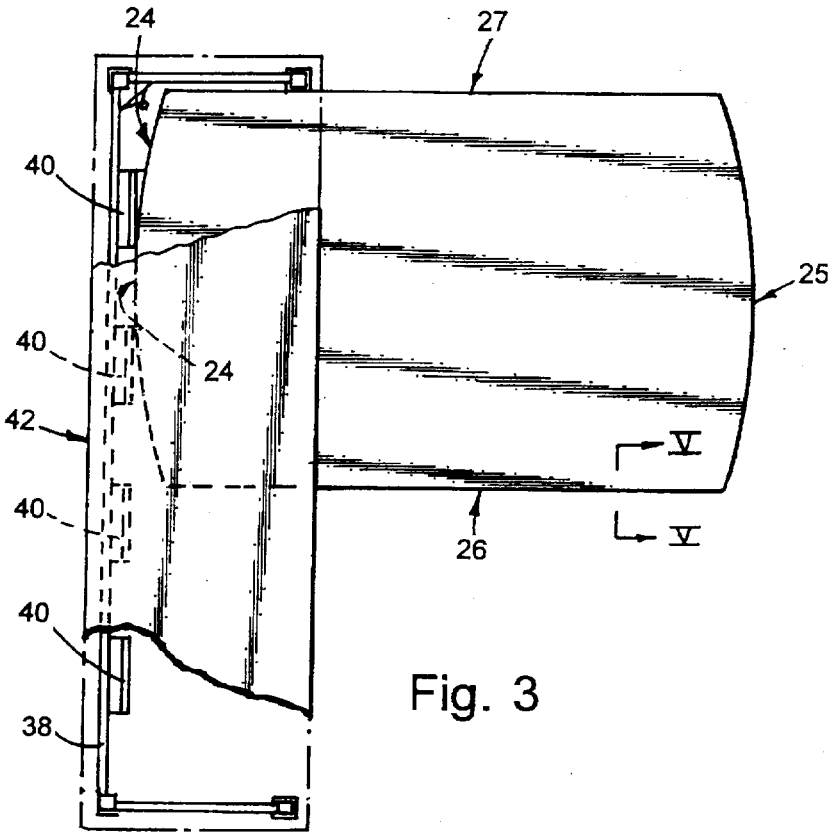
FIG. 3 is a top plan view of the nested table system arranged in an L-shaped configuration, with portions broken away to show details beneath the worksurface of the stationary table.
Figure 4:
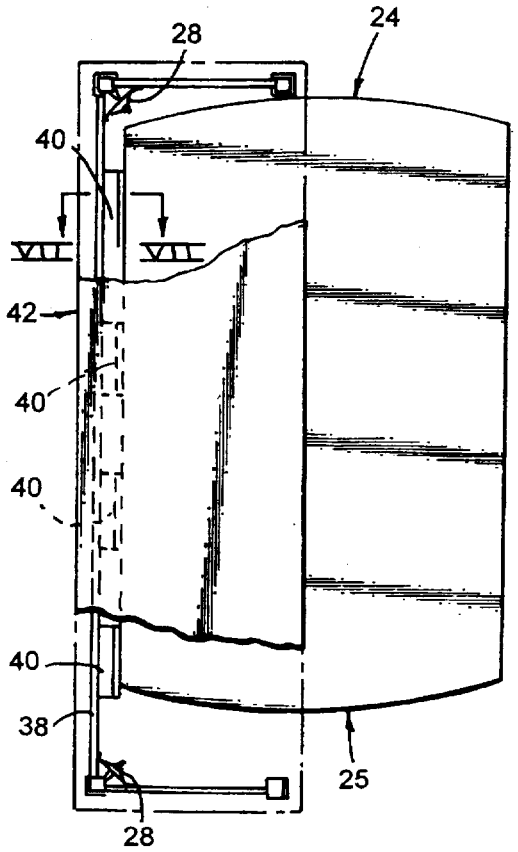
FIG. 4 is a top plan view of the nested table system arranged in a nested position, with portions broken away.

Stationary table 12 and movable table 18 include cooperative elements which combine to prevent the edge of worksurface 20 of the movable table from being damaged if undesirable impact between the edge of table 18 and portions of the stationary table should occur inadvertently when the nested table system is being rearranged. The first of these cooperative elements involves a relationship between the shape and size of the worksurface 20 of movable table 18 and the positioning of legs 16 of stationary table 12 which serves to reduce or eliminate the possibility of damage to the edges of worksurface 20 in case of inadvertent, undesirable collisions between the edge of worksurface 20 and the stationary table. More specifically, with reference to FIGS. 3 and 4, it can be seen that the legs 16 of stationary table 12 are positioned substantially at the corners of the rectangular worksurface 14 and sufficiently spaced apart with respect to the length of table 12 so that the movable table 18 can be easily rolled under stationary table 12 with the length direction of movable table 18 aligned with the length direction of stationary table 12. That is, the distance between front legs **16*a* and 16*b*, and also the distance between rear legs 16*c* and 16*d*, are greater than the maximum distance from one side edge 24 to the opposing side edge 25 of worksurface 20 of movable table 18 along a lengthwise line parallel to the front edge 26 or rear edge 27 of worksurface 20, so that collision between the edges 24, 25 and legs 16*a*, 16*b* can be easily avoided while exercising a minimal amount of care when movable table 18 is being withdrawn from underneath stationary table 12, or moved underneath the stationary table into the nested configurations shown in FIGS. 2 and 4. Additionally, worksurface 20 of movable table 18 has parallel, straight front and back edges and arcuate side edges 24, 25 having a radius of curvature which, together with a rear wall 38 which extends downwardly from the rear edge of worksurface 14 below the level of the worksurface 20, ensures that the corners of worksurface 20 cannot contact the rear legs 16*c*, 16*d* or rear corner brackets 28 regardless of the relative position of movable table 18 underneath the worksurface 14 of stationary table 12, as is indicated in FIGS. 3 and 4**.

Figure 6:
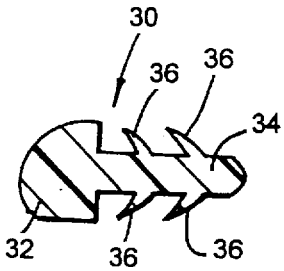
FIG. 6 is an enlarged transverse cross-section of the bumper molding on the edge of the movable table showing details thereof.
Figure 5:
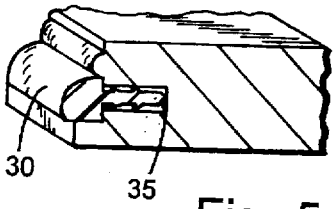
FIG. 5 is a fragmentary, cross-sectional view of an edge of the movable table as seen along line V—V of FIG. 3.

Another feature of the nested table system 10 of the invention which helps reduce or eliminate the possibility of damage to the edges of worksurface 20 in the event of collision between the edges of worksurface 20 and stationary table 12 is a bumper molding 30 which projects outwardly from the sides or edges of worksurface 20 of movable table 18, continuously along the entire perimeter thereof including side edges 24, 25, front edge 26, and rear edge 27, as shown in FIG. 5. The bumper molding 30, shown in cross-section in FIG. 6, includes a bulbous head or bumper portion 32 which projects outwardly from the edges of the worksurface 20, and a stem or shank portion 34 which is received within a channel or groove 35 which extends continuously along the peripheral sides or edges of worksurface 20 of movable table 18. The stem portion preferably includes a plurality of barb-like projections 36 which help to retain the bumper molding 30 within groove 35 by means of a frictional interference type fit. Adhesives may also be used to help retain bumper molding 30 within channel 35. Bumper molding 30 is preferably made of a resiliently deformable polymeric material such as rubber or a flexible thermoplastic. The bumper moldings 30 prevent direct contact between the edges of worksurface 20 and the legs **16*a*, 16*b* of stationery table 12 in the event that movable table 18 is positioned in abutment with the legs of the stationary table as shown in FIGS. 3 and 4**.

Figure 7:
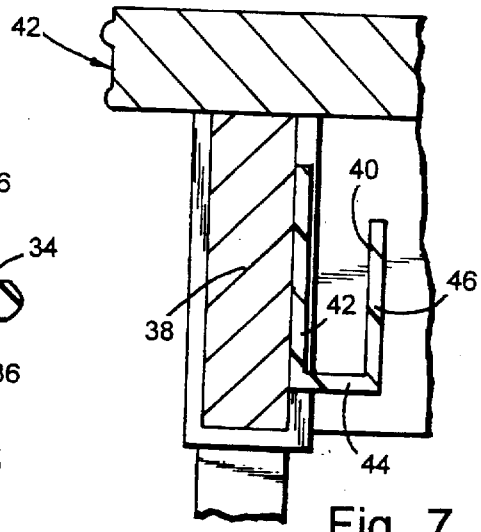
FIG. 7 is a fragmentary, cross-sectional view of the rear edge of the stationary table, with a cable manager secured thereto, as viewed along lines VII—VII of FIG. 4.

A further feature of the nested table system 10 which prevents contact between the edges 24, 25, 26, 27 of worksurface 20 of movable table 18 and the rear wall 38 of stationary table 12 is a plurality of cable management channels 40 (see FIGS. 3, 4, 7 and 9) made of an energy absorbing, preferably resiliently deformable polymeric material such as a plasticized polyvinyl chloride composition. The cable management channels 40 serve the dual function of providing a means of routing electrical power cables and/or low voltage communications wires from the worksurface 14 of stationary table 12 to a floor or wall electrical outlet and/or a telephone socket, and of acting as bumpers which prevent direct impact between the edges of worksurface 20 of moveable table 18 and the rear wall 38 which extends downwardly from worksurface 14 near the rear edge thereof. The cable management channels 40, one of which is shown in transverse cross-section in FIG. 7, has a J-shaped profile with a larger upright leg 42 which is secured to rear wall 38 such as with adhesives and/or other fasteners such as screws, a substantially horizontal support section 44 on which an electrical power cable and/or a telephone wire can be routed, and a shorter upright section 46 which projects upwardly from the inboard edge (i.e. the edge closer to the center of table 12) of support section 44 to retain cables and or wires routed on the cable management channels 40.

The legs 16 of stationary table 12 include an upper portion 48 having an enlarged cross-section with surfaces which project inwardly toward the center of the stationary table beyond the inboard side of opposing walls 50. The enlarged upper portions 48 of legs 16 extend downwardly from the underside of worksurface 14 to an elevation below that of the edges of worksurface 20 of movable table 18 to act as bumpers which prevent or at least minimize contact between the edges of worksurface 20 and other portions of stationary table 12. The enlarged upper portion 48 of legs 16, which are generally highly visible to a person repositioning movable table 18, also serve as a visual guide which allows a person to easily rearrange the table system 10 without bumping the edges of the movable table. That is, by taking a minimum amount of care to avoid collision of the edges of worksurface 20 of movable table 18 with the enlarged portions 48 of legs 16 of stationary table 12, damage to the edges of the worksurface 20 can be completely avoided. However, should the edges of worksurface 20 inadvertently come in contact with the upper portions 48 of legs 16, then the bumper molding 30 will generally absorb the energy of impact and prevent damage to the worksurface 20 and legs 16.

Figure 8:
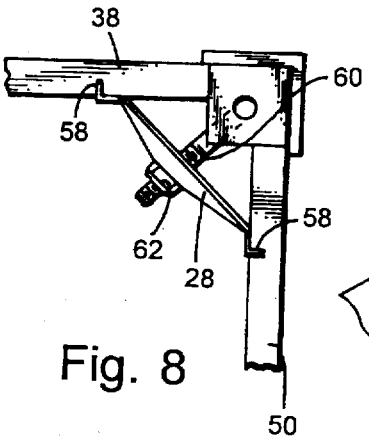
FIG. 8 is an enlarged, fragmentary top view of a rear corner of the stationary table with the worksurface removed to show details of a corner stiffening bracket.

The worksurfaces 14 and 20 of the stationary table 12 and movable table 18, respectively, are preferably made of wood, and desirably include a high pressure laminate top sheet. Likewise, the legs 22, sidewalls 52, and front and backwalls 54 of movable table 18 are preferably wood. The rearwall 28, endwalls 50 and enlarged portions 48 at the upper end of legs 16 are also preferably wood. The legs 16 can also be made of wood but are preferably made of steel. Likewise, horizontal cross members 56, which improve the rigidity and structural strength of stationary table 12, are also preferably steel. Most desirably, the enlarged sections at the upper ends of legs 16 are hollow wood parts into which the upper ends of steel legs 16 are inserted. The various components of tables 12 and 18 are fabricated and assembled using generally well known furniture construction techniques which can involve the use of dowels, adhesives, screws and various other conventional fastening techniques. Brackets 28, shown in FIGS. 3, 4 and 8, are used to improve the strength and rigidity of stationary table 12. More specifically, brackets 28 are positioned at each of the two rear corners of table 12. Brackets 28 each includes a steel plate-like member having prongs 58 which bite or project into rearwall 38 and endwall 50 and a threaded bore for receiving a bolt 60 secured to legs 16*c* and 16*d*, respectively. A nut 62 is used to secure the bracket to the corners of table 12. Similar stiffening brackets can be used at the corners of movable table 18 to improve the strength and rigidity thereof. The casters 24 are conventional furniture casters which allow table 18 to be freely rotated and or linearly repositioned as desired.

Figure 9:
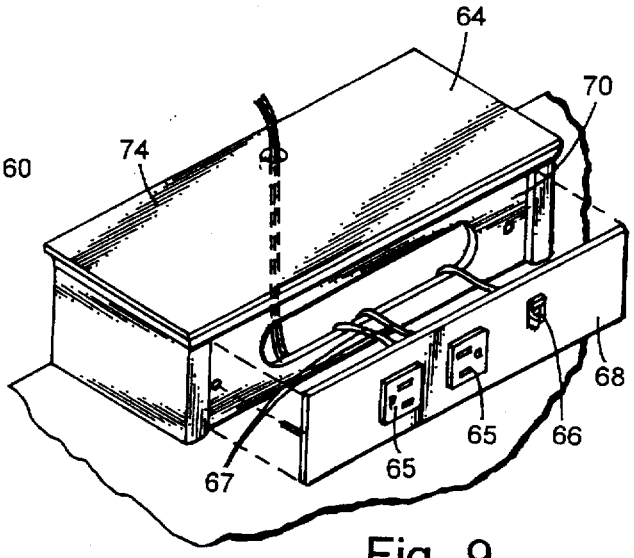
FIG. 9 is an enlarged, fragmentary, perspective view of the utility unit located at the top of the worksurface of the stationary table.

In accordance with a preferred aspect of the invention, stationary table 12 is provided with a box-like utility unit 64, shown in FIGS. 1, 2 and 9, having electrical outlets 65 and a telephone outlet 66. Electrical power cables 67 are routed from outlets 66 secured to face plate 68, through a slot in the front panel 70 of unit 64 through an aperture (not shown) passing through worksurface 14 which is concealed by the utility unit 64, optionally along one or more of the cable managers 40, and down to a floor or wall electrical outlet. The cable managers 40 provide a convenient means for concealing excess cable which can be bunched up and laid in one of the cable managers. The cable managers also allow cable to be routed horizontally along the rearwall 38 of the stationary table 12 so that a minimum length of cable routed from the table 12 to an electrical outlet is exposed.

The stationary table 12 also preferably includes an articulated lamp assembly 72 (FIG. 1) which is mounted to the top 74 of utility unit 64. The lamp assembly 72 includes a first arm 76 which can be pivoted in generally any direction about a universal pivot joint 78, and second arm 80 which can be pivoted about pivot joint 82. Light fixture 84 can also be pivoted with respect to arm 80 about pivot joint 86. The arms 76, 80 are preferably of sufficient length to allow positioning of the lamp 84 over generally any location on worksurface 14 of stationary table 12, and over generally any location on worksurface 20 of moveable table 18 when the moveable table is at least partially nested such as shown in FIGS. 1 and 2.

The embodiments of the invention in which an exclusive property or privilege is claimed are defined as follows:

1. A nested table system comprising:

a stationary table having a rectangular worksurface with a rear edge, a front edge and opposing side edges, a pair of rear legs located substantially at the corners at which the rear edge intersects with the side edges of said rectangular worksurface, and a pair of front legs located substantially at the corners at which the front edge intersects with the side edges of said rectangular worksurface, said stationary table including a rearwall which extends downwardly from said rear edge of said worksurface of said stationary table; and a movable table which is translatable independently of said stationary table and which is unconnected to said stationary table, said movable table having a substantially horizontal worksurface supported by a plurality of legs, each of which is supported on a caster;

said worksurface of said stationary table having an underside which is supported at a height which is greater than a height at which a top side of said worksurface of said movable table is supported, and said legs of said worksurface of said stationary table being sufficiently spaced apart to allow at least a portion of said worksurface of said movable table to be positioned underneath said worksurface of said stationary table;

said rearwall extending below the level of said worksurface of said movable table when said movable table is positioned underneath said stationary table, said worksurface of said movable table having substantially straight, parallel front and back edges and arcuate side edges at opposite ends of said worksurface, said arcuate edges having a radius of curvature which cooperates with said rearwall of said stationary table to prevent the corners at the intersection between said straight and said arcuate edges of said movable table from contacting said rear legs of said stationary table regardless of the relative position of said movable table underneath said worksurface of said stationary table;

said worksurface of said movable table including a bumper molding which projects outwardly from edges thereof, whereby damage to said edges can be avoided should said edges collide with said legs of said stationary table.

2. The nested table system of claim 1, wherein said rearwall of said stationary table includes a plurality of cable management channels secured thereto for routing cable from said worksurface of said stationary table to a floor or wall outlet.

3. The nested table system of claim 2, wherein said cable management channels are of an energy absorbing, resiliently deformable polymeric material.

4. The nested table system of claim 1, wherein said stationary table includes opposing endwalls which extend downwardly from the worksurface at opposite sides of said stationary table to a level below the height of said worksurface of said movable table and said legs of said stationary table include an upper portion with an enlarged cross-section having surfaces which project inwardly beyond the inboard sides of said endwalls, whereby said enlarged portions of said legs act as bumpers which minimize contact between the edges of said worksurface of said movable table and said stationary table, and act as a conspicuous visual guide to promote reconfiguring of said table system without bumping said edges of said movable table against the legs of said stationary table.

5. The nested table system of claim 4, wherein said legs of said stationary table are steel, and said upper portion of each of said legs is a hollow wooden part into which an upper end of one of said legs is disposed.

6. The nested table system of claim 1, wherein said bumper molding extends continuously along the entire perimeter of said worksurface of said moveable table.

7. The nested table system of claim 6, wherein said bumper molding is of a resiliently deformable polymeric material.

8. The nested table system of claim 7, wherein said bumper molding has a transverse profile which includes a bulbous head portion and a stem portion, said stem portion being received within a groove in the edges of said worksurface of said moveable table.

9. The nested table system of claim 7; wherein said worksurfaces are comprised of wood.

10. A nested table system, comprising:

a movable table having a substantially horizontal worksurface, with substantially straight, parallel front and back edges and arcuate side edges at opposite ends of said worksurface, said worksurface of said movable table being supported by a plurality of legs, each of which is supported on a caster;

a stationary table having a substantially horizontal, rectangular worksurface with a rear edge, a front edge and opposing side edges, a pair of rear legs located substantially at the corners at which the rear edge intersects with the side edges of said rectangular worksurface, a pair of front legs located substantially at the corners at which the front edge intersects with the side edges of said rectangular worksurface, and a rearwall which extends downwardly from said rear edge of said worksurface of said stationary table below the level of said worksurface of said movable table;

said movable table being translatable independent of said stationary table and being unconnected to said stationary table;

said worksurface of said stationary table having an underside which is supported at a height which is greater than a height at which a top side of said worksurface of said movable table is supported, and said front legs of said worksurface being sufficiently spaced apart to allow at least a portion of said worksurface of said movable table to be positioned underneath said worksurface of said stationary table;

said arcuate edges having a radius of curvature which together with said rearwall of said stationary table prevent the corners at the intersection between said straight and said arcuate edges of said worksurface of said movable table from contacting said rear legs of said stationary table regardless of the relative position of said movable table underneath said worksurface of said stationary table.

11. The nested table system of claim 10, wherein said worksurface of said movable table includes a bumper molding which projects outwardly from the edges thereof, whereby damage to said edges can be avoided should said edges collide with said front legs of said stationary table.

12. The nested table system of claim 11, wherein said rearwall of said stationary table includes a plurality of cable management channels secured thereto for routing cable from said worksurface of said stationary table to a floor or wall outlet.

13. The nested table system of claim 12, wherein said stationary table includes opposing endwalls which extend downwardly from the worksurface at opposite sides of said stationary table to a level below the height of said worksurface of said movable table and said legs of said stationary table include an upper portion with an enlarged cross-section having surfaces which project inwardly beyond the inboard sides of said endwalls, whereby said enlarged portions of said legs act as bumpers which minimize contact between the edges of said worksurface of said movable table and said stationary table, and act as a conspicuous visual guide to promote reconfiguring of said table system without bumping said edges of said movable table against the legs of said stationary table.

14. The nested table system of claim 13, wherein said legs of said stationary table are steel, and said upper portion of each of said legs is a hollow wooden part into which an upper end of one of said legs is disposed.

15. The nested table system of claim 12, wherein said cable management channels are of an energy absorbing, resiliently deformable polymeric material.

16. The nested table system of claim 15, wherein said worksurfaces are comprised of wood.

17. The nested table system of claim 11, wherein said bumper molding extends continuously along the entire perimeter of said worksurface of said moveable table.

18. A nested table system, comprising:

a movable table having a substantially horizontal worksurface supported by a plurality of legs, each of which is supported on a caster;

a stationary table having a substantially horizontal, rectangular worksurface with a rear edge, a front edge and opposing side edges, a pair of rear legs located substantially at the corners at which the rear edge intersects with the side edges of said rectangular worksurface, a pair of front legs located substantially at the corners at which the front edge intersects with the side edges of said rectangular worksurface, and a rearwall which extends downwardly from said rear edge of said worksurface of said stationary table;

said movable table being translatable independently of said stationary table and being unconnected to said stationary table;

said worksurface of said stationary table having an underside which is supported at a height which is greater than a height at which a top side of said worksurface of said movable table is supported, and said front legs of said worksurface of said stationary table being sufficiently spaced apart to allow at least a portion of said worksurface of said movable table to be positioned underneath said worksurface of said stationary table;

said rearwall extending below the level of said worksurface of said movable table when said movable table is positioned underneath said stationary table, said worksurface of said movable table having substantially straight, parallel front and back edges and arcuate side edges at opposite ends of said worksurface, said arcuate edges having a radius of curvature which cooperates with said rearwall of said stationary table to prevent the corners at the intersections between said straight and said arcuate edges of said movable table from contacting said rear legs of said stationary table regardless of the relative position of said movable table underneath said worksurface of said stationary table;

a plurality of cable management channels secured to said rearwall of said stationary table, whereby cable can be routed from said worksurface of said stationary table to a floor or wall outlet.

19. The nested table system of claim 18, wherein said cable management channels are of an energy absorbing, resiliently deformable polymeric material.

20. The nested table system of claim 19, wherein said worksurface of said movable table includes a bumper molding which projects outwardly from the edges thereof, whereby damage to said edges can be avoided should said edges collide with said legs of said stationary table.

21. The nested table system of claim 20, wherein said bumper molding is of a resiliently deformable polymeric material.

* * * * *